US010271148B2

(12) United States Patent
Perman

(10) Patent No.: US 10,271,148 B2
(45) Date of Patent: Apr. 23, 2019

(54) HEARING DEVICE WITH IMPROVED INITIALISATION OF DIGITAL FEEDBACK SUPPRESSION CIRCUITRY

(71) Applicant: GN Hearing A/S, Ballerup (DK)

(72) Inventor: Shawn Perman, San Jose, CA (US)

(73) Assignee: GN Hearing A/S, Ballerup (DK)

( * ) Notice: Subject to any disclaimer, the term of this patent is extended or adjusted under 35 U.S.C. 154(b) by 70 days.

(21) Appl. No.: 15/071,506

(22) Filed: Mar. 16, 2016

(65) Prior Publication Data

US 2017/0188161 A1 Jun. 29, 2017

(30) Foreign Application Priority Data

Dec. 23, 2015 (EP) ..... 15202394

(51) Int. Cl.
*H04R 25/00* (2006.01)

(52) U.S. Cl.
CPC ..... *H04R 25/453* (2013.01); *H04R 25/70* (2013.01)

(58) Field of Classification Search
CPC ..... H04R 25/453; H04R 25/70
USPC ..... 381/318, 317, 60
See application file for complete search history.

(56) References Cited

U.S. PATENT DOCUMENTS 3,848,091 A 11/1974 Stearns et al.
5,619,580 A 4/1997 Hansen
5,680,467 A 10/1997 Hansen
6,498,858 B2 12/2002 Kates
2014/0270292 A1 9/2014 Hillbratt et al.

FOREIGN PATENT DOCUMENTS

EP 2 205 005 A1 7/2010
WO WO 96/35314 A1 11/1996
WO WO 2005/081584 9/2005

OTHER PUBLICATIONS

Extended European Search Report dated Jul. 5, 2016 for corresponding EP Patent Application No. 15202394.1, 7 pages.
Daniel Kahneman and Richard H. Thaler: "Anomalies: Utility Maximization and Experienced Utility", The Journal of Economic Perspectives, vol. 20, No. 1 (Winter, 2006), pp. 221-234, published by American Economic Association, 14 pages.
Communication pursuant to Article 94(3) EPC dated May 26, 2017 for corresponding European Patent Application No. 15 202 394.1, 4 pages.

*Primary Examiner* — Phylesha Dabney
(74) *Attorney, Agent, or Firm* — Vista IP Law Group, LLP

(57) ABSTRACT

A method of modelling a feedback path from a receiver to a microphone in a hearing device, includes: transmitting an electronic probe signal to the receiver; obtaining a microphone output signal that is associated with an output of the receiver; and determining at least one parameter of the feedback path based on the microphone output signal; wherein the electronic probe signal comprises a first signal level, followed by a second signal level that is less than the first signal level, the second signal level being greater than zero.

53 Claims, 5 Drawing Sheets

(a)

(b)

HEARING DEVICE WITH IMPROVED INITIALISATION OF DIGITAL FEEDBACK SUPPRESSION CIRCUITRY

RELATED APPLICATION DATA

This application claims priority to and the benefit of European Patent Application No. 15202394.1 filed on Dec. 23, 2015, pending. The entire disclosure of the above application is expressly incorporated by reference herein.

FIELD

The present disclosure relates to a hearing device, such as a hearing aid, with digital feedback suppression circuitry having parameters that are initialised, e.g. during fitting of the hearing device to a specific user.

BACKGROUND

Feedback is a well known problem in hearing devices and systems for suppression and cancellation of feedback are well-known in the art, see e.g., U.S. Pat. No. 5,619,580, U.S. Pat. No. 5,680,467 and U.S. Pat. No. 6,498,858.

Conventionally, a Digital Feedback Suppression Circuit is employed in hearing devices to suppress the feedback signal from the receiver output. During use, the Digital Feedback Suppression Circuit estimates the feedback signal, e.g. utilising one or more digital adaptive filters that model the feedback path. The feedback estimate from the Digital Feedback Suppression Circuit is subtracted from the microphone output signal to suppress the feedback signal.

The feedback signal may propagate from the receiver back to the microphone along an external signal path outside the hearing device housing and along an internal signal path inside the hearing device housing.

External feedback, i.e. propagation of sound from the receiver to the microphone of the hearing device along a path outside the hearing device, is also known as acoustical feedback. Acoustical feedback occurs, e.g., when a hearing device ear mould does not completely fit the wearer's ear, or in the case of an ear mould comprising a canal or opening for, e.g., ventilation purposes. In both examples, sound may "leak" from the receiver to the microphone and thereby cause feedback.

Internal feedback may be caused by sound propagating through air inside the hearing device housing, and by mechanical vibrations in the hearing device housing and in components inside the hearing device housing. The mechanical vibrations are generated by the receiver and are transmitted to other parts of the hearing device, e.g. through receiver mounting(s). In some hearing devices, the receiver is flexibly mounted in the housing, whereby transmission of vibrations from the receiver to other parts of the hearing device is reduced.

WO 2005/081584 discloses a hearing device having two separate digital feedback suppression circuits, namely one for compensation of the internal mechanical and acoustical feedback and one for compensation of the external feedback.

The external feedback path extends "around" the hearing device and is therefore usually longer than the internal feedback path, i.e. sound has to propagate a longer distance along the external feedback path than along the internal feedback path to get from the receiver to the microphone. Accordingly, when sound is emitted from the receiver, the part of it propagating along the external feedback path will arrive at the microphone with a delay in comparison to the part propagating along the internal feedback path. Therefore, it is preferred that the separate digital feedback suppression circuits operate on first and second time windows, respectively, and that at least a part of the first time window precedes the second time window. Whether the first and second time windows overlap or not, depends on the length of the impulse response of the internal feedback path.

While external feedback may vary considerably during use, internal feedback is more constant and typically coped with during the manufacturing process.

It is well-known that accurate initialisation of the Digital Feedback Suppression Circuit is essential for effective suppression of feedback in the hearing device. Although in principle, an adaptive filter automatically adapts to changes of the feedback path, there are limitations to the extent and accuracy of feedback path changes that the adaptive filter can track. However, accurate initialization of the Digital Feedback Suppression Circuit leads to fast and accurate modelling of the feedback path response and effective feedback suppression during subsequent operation by provision of a starting point for the adaptation that is close to the desired end result. The initialisation may take place during a fitting session and possibly whenever the user turns the hearing device on.

Typically, the Digital Feedback Suppression Circuit is initialized during fitting of the hearing device to a specific user. The hearing device is connected to a PC, and a probe signal is transmitted to the receiver, and based on the microphone output signal that includes a response to the probe signal, the impulse response of the feedback path is estimated. Typically, the probe signal is 10 seconds long and has a high level that disturbs the user. In order to allow the user to adapt to the probe signal, the probe signal is ramped linearly on a logarithmic scale from zero during one second preceding the ten seconds constant signal level of the probe signal. The received microphone output signal is transmitted to the PC and the respective impulse response is calculated. Then the PC determines the parameters required by the Digital Feedback Suppression Circuit, e.g. filter coefficients of fixed digital filters and initial filter coefficients of an adaptive digital filter, to be capable of modelling the feedback path.

In a hearing device with more than one microphone, e.g. having a directional microphone system, the hearing device may comprise separate Digital Feedback Suppression Circuits for each microphone that are initialised separately utilising the same probe signal.

Hearing device users have complained about discomfort and pain during the initialisation process.

Recently, open solutions have emerged. In accordance with hearing device terminology, a hearing device with a housing that does not obstruct the ear canal when the housing is positioned in its intended operational position in the ear canal; is categorized "an open solution". The term "open solution" is used because of the passageway between a part of the ear canal wall and a part of the housing allowing sound waves to escape from behind the housing between the ear drum and the housing through the passageway to the surroundings of the user. With an open solution, the occlusion effect is diminished and preferably substantially eliminated.

Typically, a standard sized hearing device housing which fits a large number of users with a high level of comfort represents an open solution.

Open solutions may lead to feedback paths with long impulse responses, since the receiver output is not separated from the microphone input by a tight seal in the ear canal.

This makes the feedback path relatively open leading to a long impulse response which may further increase the required duration of the probe signal for estimation of the feedback path.

Thus, it is desirable to provide a way of initialising the Digital Feedback Suppression Circuit that reduces user discomfort during the initialisation process.

EP 2 205 005 A1 discloses a hearing instrument with digital feedback suppression circuitry having parameters that are initialised, e.g. during fitting of the hearing instrument to a specific user, according to a method of modelling a feedback path from a receiver to a microphone of the hearing instrument, comprising the initialisation steps of transmitting an electronic probe signal to the receiver for conversion into an acoustic probe signal output by the receiver while recording the microphone output signal, and determining at least one parameter of the feedback path based on the recorded microphone output signal, and wherein the step of transmitting a probe signal to the receiver comprises the steps of increasing the level of the probe signal while monitoring values of a first quality parameter calculated based on the recorded microphone output signal, and refraining from further increasing the level of the probe signal when the determined first quality parameter has reached a predetermined first threshold value.

SUMMARY

Accordingly, a new initialisation process is provided wherein the signal level as a function of time and the duration of the probe signal is set as required for appropriate initialization of the Digital Feedback Suppression Circuit. The initialisation process is finalized with a time period during which the signal level of the probe signal is decreased so that the initialisation process is terminated with a signal level of the probe signal that is smaller than a previous signal level, such as a peak level, an average level, an rms level, etc., of the probe signal during the initialisation process before optional turn-off of the probe signal or lowering of the signal level to an inaudible level.

Discomfort experienced by the user that has to listen to the probe signal is alleviated by decreasing the signal level of the probe signal at the end of the initialisation process due to the so-called "peak/end rule" and "duration neglect" discovered by Nobel Prize winner in Economics Daniel Kahneman, see Daniel Kahneman and Richard H. Thaler: "Anomalies: Utility Maximization and Experienced Utility", The Journal of Economic Perspectives, Vol. 20, No. 1 (Winter, 2006), pp. 221-234, published by American Economic Association.

By "duration neglect", retrospective evaluations of episodes are radically insensitive to variations of duration.

By the "peak/end rule", extending a period of pain can improve its remembered utility if the peak is unchanged and the new end is less aversive than the original end.

Thus, a first period of high pain followed by a second period of reduced pain was rated less painful than the first period experienced alone, i.e. ending abruptly.

This observation is utilized in the new initialisation process to alleviate user discomfort caused by the probe signal.

For example, the initialisation process may be finalized with a time period during which the signal level of the probe signal is decreased linearly from its current value, e.g. by more than 1%, such as by more than 2%, such as by more than 5%, such as by more than 10%, such as by more than 20%, such as by more than 50%, etc., below a previous signal level, such as a peak signal level, an average signal level, an rms signal level, etc., of the probe signal.

The initialisation process may be finalized with a time period during which the signal level of the probe signal is decreased in one or more steps of similar magnitude from its current value, e.g. by more than 1%, such as by more than 2%, such as by more than 5%, such as by more than 10%, such as by more than 20%, such as by more than 50%, etc., below a previous signal level, such as a peak signal level, an average signal level, an rms signal level, etc., of the probe signal.

The initialisation process may be finalized with a time period during which the signal level of the probe signal is decreased linearly on a logarithmic scale, e.g. by more than 1 dB, such as by more than 2 dB, such as by more than 3 dB, such as by more than 4 dB, such as by more than 5 dB, such as by more than 6 dB, etc., below a previous signal level, such as a peak signal level, an average signal level, an rms signal level, etc., of the probe signal.

The time period of finalizing the initialisation process during which the signal level of the probe signal is decreased, may be more than 10%, such as more than 20%, more than 30%, more than 40%, more than 50%, more than 60% of the time period required for appropriate initialization of the Digital Feedback Suppression Circuit.

The initialisation process may have finalized initialisation of parameters of the Digital Feedback Suppression Circuit before finalizing the initialisation process with a time period during which the signal level of the probe signal is decreased.

The initialisation process may continue initialisation of parameters of the Digital Feedback Suppression Circuit during finalizing the initialisation process with a time period during which the signal level of the probe signal is decreased.

The initialisation process may start with ramping of the probe signal, e.g. linearly on a logarithmic scale, from a low level, such as an inaudible level, e.g. a zero level, while the value of a first quality parameter is monitored. When the first quality parameter value has reached a predetermined first threshold value, the probe signal is kept constant at the corresponding signal level while the value of a second quality parameter is monitored. When the second quality parameter value has reached a predetermined second threshold value, the probe signal level is decreased again, e.g. to an inaudible level, e.g. is turned off.

Accordingly, a new initialisation process is provided wherein the signal level as a function of time and the duration of the probe signal is set as required for appropriate initialization of the Digital Feedback Suppression Circuit, and wherein the initialisation process is finalized with a time period during which the signal level of the probe signal is decreased so that the initialisation process is terminated with a signal level of the probe signal that is lower than a previous peak signal level of the probe signal during the initialisation process before optional turn-off of the probe signal or lowering of the probe signal level to an inaudible level.

The level and duration of the probe signal may be kept at a minimum required for appropriate initialization of the Digital Feedback Suppression Circuit. Initially, the probe signal may be ramped, e.g. linearly on a logarithmic scale, from a low level, such as an inaudible level, e.g. a zero level, while the value of a first quality parameter is monitored. When the first quality parameter value has reached a predetermined first threshold value, the probe signal is kept constant at the corresponding signal level while the value of a second quality parameter is monitored. When the second quality parameter value has reached a predetermined second threshold value, the initialisation process is finalized by decreasing the signal level of the probe signal level as explained above.

The signal level may be defined as the sound pressure level (SPL) the hearing device generates, e.g. in front of the tympanic membrane, or at the acoustic input of a microphone of the hearing device or of a separate microphone that is not a part of the hearing device.

The sound pressure level is a logarithmic measure of the rms sound pressure of a sound relative to a reference value. It is measured in decibels (dB). The commonly used reference sound pressure in air is 20 μPa (rms), which is usually considered the threshold of human hearing.

The sound pressure level is controlled by the signal level, e.g. the rms value, of the electronic input signal to the receiver of the hearing device.

The resulting sound pressure level need not be determined. The resulting maximum sound pressure level reached will be a function of the first and second threshold values of the first and second quality parameters, respectively.

The sound pressure level may be determined at selected frequencies, or within a selected frequency range, or as a function of frequency, or, the sound pressure level may be determined in substantially the whole frequency range of the probe signal.

During monitoring of the quality parameters, the quality parameter in question is calculated repeatedly based on the microphone output signal and successive values of the quality parameter are compared to the relevant first or second threshold value.

Increasing values of the first or second quality parameter may indicate increased quality of the microphone output signal. For a quality parameter of this type, the quality parameter starts at a low value and gradually increases. The respective first or second threshold value is reached when the quality parameter in question is larger than or equal to the respective threshold value.

For another type of quality parameter, decreasing values of the quality parameter indicate increased quality of the microphone output signal. For a quality parameter of this type, the quality parameter starts at a high value and gradually decreases. The respective threshold value is reached when the quality parameter in question is less than or equal to the threshold value.

For example, the first quality parameter may relate to differences in the determined impulse response of the feedback path. Ramping of the probe signal may be stopped when the determined impulse response has become sufficiently stable, i.e. when the first quality parameter, being a measure of a difference in successively determined impulse responses, is equal to or less than the first threshold value.

As another example, the first quality parameter may relate to the signal level at a microphone of the hearing device, or at an external microphone that is not a part of the hearing device, for example the first quality parameter may be equal to, or a function of, the rms value of the electronic output signal of the microphone in question.

Thus, a new method is provided of modelling a feedback path from a receiver to a microphone in a hearing device, comprising transmitting an electronic probe signal with a maximum allowable signal level and duration to the receiver for conversion into an acoustic probe signal output by the receiver while recording the microphone output signal, and determining at least one parameter of the feedback path based on the recorded microphone output signal, and finalizing the transmitting by decreasing the signal level of the probe signal so that the transmitting is terminated with a signal level of the probe signal that is smaller than a previous signal level of the probe signal.

The step of determining at least one parameter of the feedback path may be completed before finalizing the transmitting with decreasing the signal level of the probe signal.

The step of determining at least one parameter of the feedback path may continue during finalizing the transmitting with decreasing the signal level of the probe signal.

The step of transmitting the probe signal may further comprise the steps of monitoring values of a second quality parameter calculated based on the recorded microphone output signal, and terminating transmission of the probe signal to the receiver when the determined second quality parameter has reached a predetermined second threshold value.

The first quality parameter and the second quality parameter may be identical.

The method may further comprise the step of estimating the impulse response of the feedback path.

At least one of the first quality parameter and the second quality parameter may be a parameter of the impulse response.

The parameter of the impulse response may be selected from the group consisting of the peak to peak ratio of head and tail parts of the impulse response, noise to noise ratio of head and tail parts of the impulse response, and peak to signal to noise ratio of the impulse response.

In one embodiment, the Digital Feedback Suppression Circuit comprises a fixed IIR filter, and an adaptive FIR filter. The adaptive FIR filter coefficients may be updated based on minimisation of least means squared error. An adaptive filter may also be utilised that is allowed to adapt during the initialisation process. After initialisation, the filter continues its operation with frozen filter coefficients so that the filter operates as a static filter.

The probe signal may be a maximum length sequence, e.g. a repeated 255-sample maximum length sequence, a broadband noise signal, etc. With a maximum length sequence, generation of standing waves is avoided.

The recorded microphone output signal that includes a response to the probe signal may be uploaded to an external computer that is adapted for estimating the feedback signal path and for transferring the estimate to the Digital Feedback Suppression Circuit, e.g. by transferring determined parameters to the Digital Feedback Suppression Circuit, such as filter coefficients of fixed digital filters and of an adaptive digital filter.

In one embodiment, the Digital Feedback Suppression Circuit comprises an adaptive filter that is allowed to adapt during transmission of the probe signal to the receiver. Initialisation may be terminated when the changes of the filter coefficients have become less than a predetermined threshold value constituting the second threshold value, the change of the filter coefficients from one adaptation cycle to the next constituting the second quality parameter value.

According to the provided method, user discomfort is reduced or eliminated due to use of a probe signal with a signal level or amplitude which is sufficiently large to facilitate estimation of the feedback path, but not larger than required.

Determination of the required probe signal level may be performed starting transmission of the probe signal to the receiver from a low level, e.g. a inaudible level, such as 0 $dB_{APL}$, and gradually increasing the level of the probe signal until the impulse response of the feedback path is deemed to be of sufficient quality for determination of the required parameters, e.g. by monitoring changes in a determined parameter of the impulse response constituting the first quality parameter and stopping increase of the level of the probe signal when the changes are less than the first threshold value.

A maximum allowable signal level and duration of the probe signal may be imposed, e.g., which are equivalent to what the standard initialization signal level and duration would have been according to the conventional initialisation process.

Likewise, transmission of the probe signal at the determined constant level may be stopped when impulse response determination is deemed to be of sufficient quality thereby making duration of the probe signal as short as possible.

The determined required level of the probe signal may vary in dependence of the type and model of the hearing device, and the type of fitting (open/closed).

The rate of increase and/or decrease of the probe signal level may be varied in dependence of the expected required signal level and a predetermined time period set to reach the expected required signal level. The expected signal level may for example be 85 $dB_{SPL}$ for a non-hearing impaired user. At the level of 85 $dB_{SPL}$, there is generally no discomfort experienced by a person of normal hearing. It should be noted that hearing impaired users are generally subjected to far higher initialization levels, such as 102 $dB_{SPL}$. The level may reach the maximum of the output level of the device (e.g. 120 $dB_{SPL}$) but is limited at a level which limits distortion caused from overdriving the receiver.

Calculations of the first and second quality parameters and parameters of a Digital Feedback Suppression Circuit may be performed in a computer external to the hearing device and thus, a bi-directional data communication link may be established between the hearing device and the external computer as is well-known in the art. The external computer may receive the microphone output signal and may control the probe signal generator, e.g., start and stop signal generation by the probe signal generator, current signal level of the probe signal generator output, etc., in accordance with calculations of the first and possibly the second quality parameter.

Calculations and control required to perform the initialisation process may be shared between the external computer and the hearing device in a variety of ways, e.g. all required tasks of the initialisation process may be performed in the hearing device provided that the signal processor has sufficient computational power and memory for the corresponding program to be executed.

Thus, a hearing device is provided comprising a microphone for converting incoming sound into an audio signal, a Digital Feedback Suppression Circuit for modelling a feedback path of the hearing device, a signal processor for processing the audio signal into a processed audio signal, a receiver connected to an output of the signal processor for converting the processed audio signal into a sound signal, a probe signal generator for generation of a probe signal to the receiver for conversion into an acoustic probe signal output by the receiver, and wherein the signal processor is further configured for operation in accordance with the method of modelling a feedback path from the receiver to the microphone.

The signal processor may be configured for recording the microphone output signal, determining parameters of the Digital Feedback Suppression Circuit based on the recorded microphone output signal, and finalizing the transmitting by decreasing the signal level of the probe signal.

The signal processor may further be configured for monitoring values of a second quality parameter calculated based on the recorded microphone output signal, and terminating transmission of the probe signal to the receiver when the determined second quality parameter has reached a predetermined second threshold value.

The signal processor may further be configured for estimating the impulse response of the feedback path.

The Digital Feedback Suppression Circuit may form a feed forward control circuit.

The Digital Feedback Suppression Circuit may form a feedback control circuit and thus, a hearing device is provided comprising a microphone for converting incoming sound into an audio signal, a Digital Feedback Suppression Circuit for generating a feedback compensation signal by modelling an external feedback path of the hearing device, a subtractor for subtracting the feedback compensation signal from the audio signal to form a feedback compensated audio signal, a signal processor connected for reception of the feedback compensated audio signal and configured for processing the compensated audio signal, a receiver connected to an output of the signal processor for converting the processed signal into a sound signal, a probe signal generator for generation of a probe signal to the receiver for conversion into an acoustic probe signal output by the receiver, and wherein the signal processor is further configured for recording the microphone output signal, and determining parameters of the Digital Feedback Suppression Circuit based on the recorded microphone output signal, characterized in that the signal processor is further configured for increasing the level of the probe signal while monitoring values of a first quality parameter calculated based on the recorded microphone output signal, and maintaining the level of the probe signal at a constant level when the determined first quality parameter has reached a predetermined first threshold value.

The Digital Feedback Suppression Circuit may be included in the signal processor.

The hearing device may be a hearing aid, such as a BTE, RIE, ITE, ITC, or CIC, etc., hearing aid including a binaural hearing aid.

The hearing device may be a headset, headphone, earphone, ear defender, or earmuff, etc., such as an Ear-Hook, In-Ear, On-Ear, Over-the-Ear, Behind-the-Neck, Helmet, or Headguard, etc.

For example, the new hearing device is a new hearing aid comprising a hearing loss processor that is configured to process the audio signal in accordance with a predetermined signal processing algorithm to generate a hearing loss compensated audio signal compensating a hearing loss of a user.

Processing, including signal processing, in the new hearing device may be performed by dedicated hardware or may be performed in a signal processor, or performed in a combination of dedicated hardware and one or more signal processors.

As used herein, the terms "processor", "central processor", "message processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "central processor", "message processor", "signal processor", "controller", "system", etc., designate both an application running on a processor and a hardware processor. One or more "processors", "central processors", "message processors", "signal processors", "controllers", "systems" and the like, or any combination hereof, may reside within a process and/or thread of execution, and one or more "processors", "central processors", "message processors", "signal processors", "controllers", "systems", etc., or any combination hereof, may be localized in one hardware processor, possibly in combination with other hardware circuitry, and/or distributed between two or more hardware processors, possibly in combination with other hardware circuitry.

A method of modelling a feedback path from a receiver to a microphone in a hearing device, includes: transmitting an electronic probe signal to the receiver; obtaining a microphone output signal that is associated with an output of the receiver; and determining at least one parameter of the feedback path based on the microphone output signal; wherein the electronic probe signal comprises a first signal level, followed by a second signal level that is less than the first signal level, the second signal level being greater than zero.

Optionally, the first signal level comprises a peak signal level, an average signal level, or an rms signal level.

Optionally, the electronic probe signal has a first signal portion with a first duration, and a second signal portion with a second duration, wherein the first signal portion comprises the first signal level, and wherein the second signal portion comprises the second signal level.

Optionally, the second signal portion decreases linearly.

Optionally, the second signal portion decreases non-linearly.

Optionally, the second signal portion decreases in a stepwise fashion.

Optionally, the second duration is more than 10%, 20%, 30%, 40%, 50%, or 60%, of a time period required for initialization of a digital feedback suppression circuit in a hearing device that comprises the receiver.

Optionally, the second signal portion comprises an end portion of the electronic probe signal.

Optionally, the act of determining the at least one parameter of the feedback path is completed before the second signal portion of the electronic probe signal is transmitted.

Optionally, at least a part of the act of determining the at least one parameter of the feedback path is performed after at least a part of the second signal portion has been transmitted.

Optionally, the method further includes: increasing a level of the electronic probe signal while monitoring values of a first quality parameter calculated based on the microphone output signal; and refraining from further increasing the level of the electronic probe signal when the determined first quality parameter has reached a predetermined first threshold value.

Optionally, the method further includes: monitoring values of a second quality parameter calculated based on the microphone output signal; and terminating the transmission of the electronic probe signal to the receiver when the determined second quality parameter has reached a predetermined second threshold value.

Optionally, the first quality parameter and the second quality parameter are identical.

Optionally, at least one of the first quality parameter and the second quality parameter is a function of the microphone output signal.

Optionally, the method further includes estimating an impulse response of the feedback path.

Optionally, the first signal level comprises a maximum allowable level.

Optionally, the electronic probe signal has a third signal level that is smaller than the second signal level.

Optionally, the third signal level comprises a zero level.

Optionally, the second signal level is less than the first signal level by an amount that is more than 1%, 2%, 5%, 10%, 20%, or 50% of the first signal level.

Optionally, the second signal level is more than 1 dB, 2 dB, 3 dB, 4 dB, 5 dB, or 6 dB, below the first signal level.

A hearing device includes: a microphone; a receiver configured to receive an electronic probe signal from a probe signal generator, wherein the electronic probe signal comprises a first signal level, followed by a second signal level that is less than the first signal level, the second signal level being greater than zero; a digital feedback suppression circuit for modelling a feedback path between the receiver and the microphone; and a signal processor configured to determine at least one parameter of the feedback path based on a microphone output signal.

Optionally, the hearing device is a hearing aid comprising a hearing loss processor for processing the audio signal into a hearing loss compensated audio signal for compensation of a hearing loss of a user of the hearing aid.

Optionally, the digital feedback suppression circuit is a part of the signal processor.

Other features, advantageous, and embodiments will be described in the detailed description.

BRIEF DESCRIPTION OF THE DRAWINGS

Other and further aspects and features will be evident from reading the following detailed description of the embodiments.

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

In the drawings:

Figure 1:
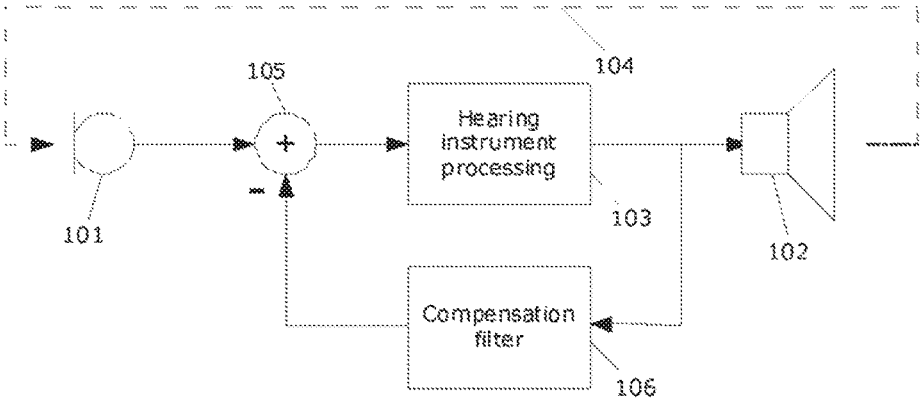
(PRIOR ART) Fig. 1
Figure 2:
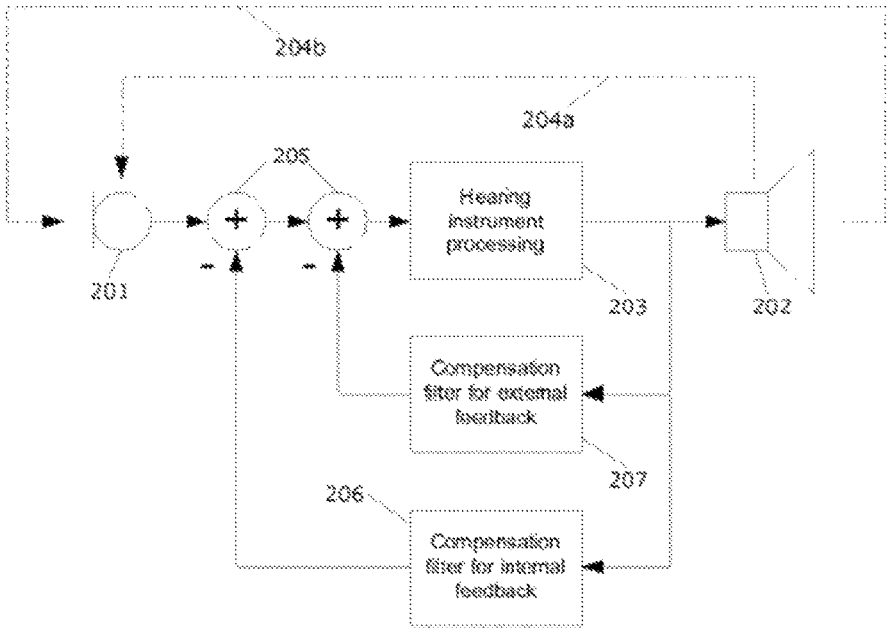
(Prior Art) Fig. 2
Figure 3:
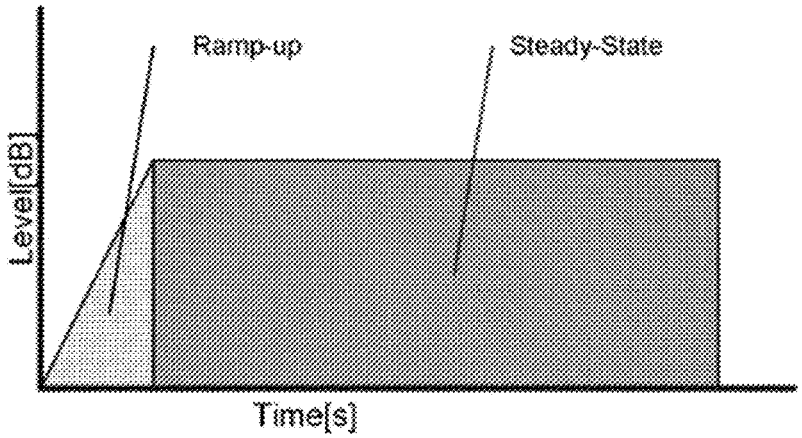
(Prior Art) FIG. 3
Figure 4:
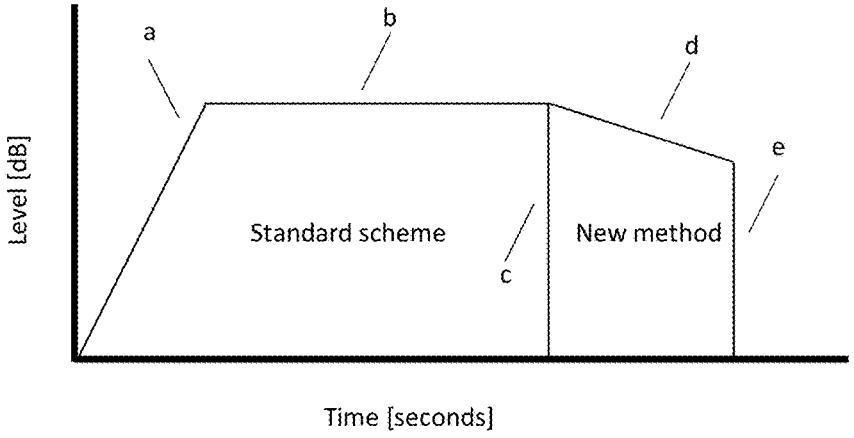
Figure 4:
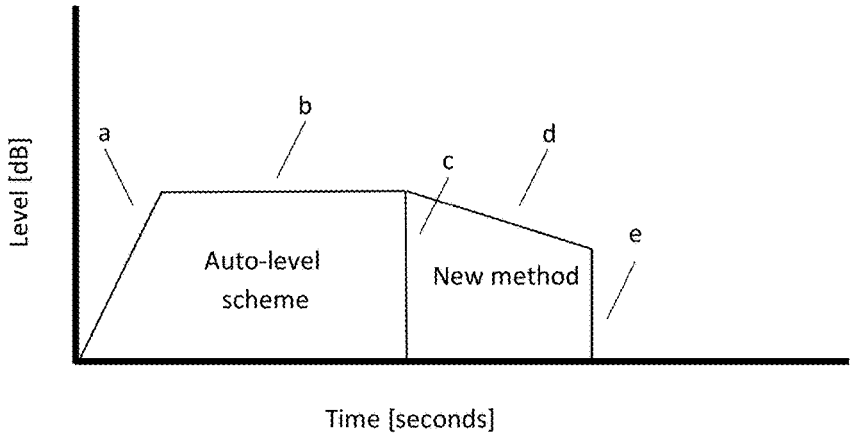
Figure 5:
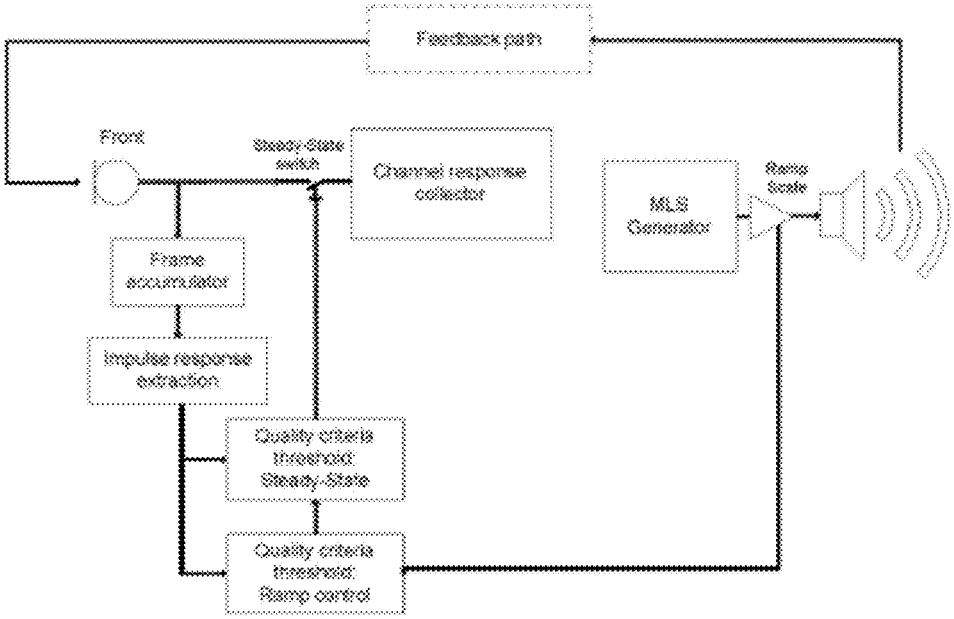

FIG. 1 shows a block-diagram of a typical hearing device system with one feedback compensation filter, FIG. 2 shows a block-diagram of a hearing device system with both internal and external feedback compensation filters, FIG. 3 is a plot of a prior art probe signal level as a function of time, FIG. 4 shows plots of prior art probe signals together with a probe signal according to the new method, and FIG. 5 is a blocked schematic illustrating the operational principles of the method.

DETAILED DESCRIPTION OF THE DRAWINGS

Various illustrative examples of the new hearing device according to the appended claims will now be described more fully hereinafter with reference to the accompanying drawings, in which various embodiments of the new hearing device and method are illustrated. The new hearing device according to the appended claims may, however, be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other examples even if not so illustrated, or if not so explicitly described.

As used herein, the singular forms "a," "an," and "the" refer to one or more than one, unless the context clearly dictates otherwise.

A block-diagram of a typical (prior-art) hearing device 100 with a feedback compensation filter 106 is shown in FIG. 1. The hearing device 100 comprises a microphone 101 for receiving incoming sound and converting it into an audio signal. A receiver 102 converts output from the hearing device processor 103 into output sound, e.g. modified to compensate for a users hearing impairment in the event that the hearing device 100 is a hearing aid. Thus, the hearing device processor 103 may comprise elements such as amplifiers, compressors, noise reduction systems, etc.

A feedback path 104 is shown as a dashed line between the receiver 102 and the microphone 101. Sound from the receiver 102 may propagate along the feedback path to the microphone 101 which may lead to well known feedback problems, such as whistling.

The (frequency dependent) gain response (or transfer function) H(ω) of the hearing device 100 (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing device processor 103.

When the feedback compensation filter 106 is enabled, it feeds a compensation signal to the subtraction unit 105, whereby the compensation signal is subtracted from the audio signal provided by the microphone 101 prior to processing in the hearing device processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, the better F'(ω) estimates the true gain function F(ω) of the feedback path, the closer H(ω) will be to the desired gain function A(ω).

As previously explained, the feedback path 104 is usually a combination of internal and external feedback paths.

A hearing device with separate Digital Feedback Suppression Circuits for compensating the internal mechanical and acoustical feedback within the hearing device housing and for compensating the external feedback, respectively, is shown in FIG. 2.

Again, the hearing device 200 comprises a microphone 201, a receiver 202 and a hearing device processor 203. An internal feedback path 204*a* is shown as a dashed line between the receiver 202 and the microphone 201. Furthermore, an external feedback path 204*b* between the receiver 202 and the microphone 201 is shown (also dashed). The internal feedback path 204*a* comprises an acoustical connection, a mechanical connection or a combination of both acoustical and mechanical connection between the receiver 202 and the microphone 201. The external feedback path 204*b* is a (mainly) acoustical connection between the receiver 202 and the microphone 201. A first compensation filter 206 is adapted to model the internal feedback path 204*a* and a second compensation filter 207 is adapted to model the external feedback path 204*b*. The first 206 and second 207 compensation filters feed separate compensation signals to the subtracting units 205, whereby feedback along both the internal and external feedback paths 204*a*, 204*b* is cancelled before processing takes place in the hearing device processor 203.

The internal compensation filter 206 models the internal feedback path 204*a*, which is usually static or quasi-static, since the internal components of the hearing device substantially do not change their properties regarding transmission of sound and/or vibrations over time. The internal compensation filter 206 may therefore be a static filter with filter coefficients derived from an open loop gain measurement, which is preferably done during production of the hearing device. However, in some hearing devices, the internal feedback path 204*a* may change over time, e.g. if the receiver is not fixed and therefore is able to move around within the hearing device housing. In this case, the internal compensation filter may preferably comprise an adaptive filter, which adapts to changes in the internal feedback path.

The external compensation filter 207 is preferably an adaptive filter which adapts to changes in the external feedback path 204*b*. These changes are usually much more frequent than the aforementioned possible changes in the internal feedback path 204*a*, and therefore the compensation filter 207 should adapt more rapidly than the internal compensation filter 206.

Because the length of the internal feedback path 204*a* is smaller than the length of the external feedback path 204*b*, the impulse response of the external feedback path 204*b* will be delayed in comparison to the impulse response of the internal feedback path 204*a* when these impulse responses are measured separately. The delay of the external feedback signal depends on the size and shape of the hearing device, but will usually not exceed 0.25 ms (milliseconds). Typical delays are 0.01 ms, such as 0.02 ms, such as 0.03 ms, such as 0.04 ms, such as 0.05 ms, such as 0.06 ms, such as 0.07 ms, such as 0.08 ms, such as 0.09 ms, such as 0.1 ms, such as 0.11 ms, such as 0.12 ms, such as 0.13 ms, such as 0.14 ms, such as 0.15 ms, such as 0.16 ms, such as 0.17 ms, such as 0.18 ms, such as 0.19 ms, such as 0.2 ms, such as 0.21 ms, 0.22 ms, such as 0.23 ms, such as 0.24 ms.

The respective impulse responses of the internal and external feedback paths 204*a*, 204*b* also differ in signal level since the attenuation along the internal feedback path 204*a* usually has reached the attenuation along the external feedback path 204*b*. Therefore, the external feedback signal will usually be stronger than the internal feedback signal.

In summary, the internal and external feedback compensation filters 206, 207 differ at least on the following three points:

1. Needed frequency of adaptation,
2. Position of impulse response in the time domain, and
3. Dynamic range of the impulse response.

Thus, provision of two compensation filters 206, 207 saves processing power in comparison to provision of one single adaptive filter due to the higher number of filter coefficients required by the single filter. Furthermore, precision may be improved because of the differences in the dynamic range.

Still further, provision of separate circuits for internal and external feedback compensation, improves the new initialisation process for the same reasons.

The internal compensation filter 206 is preferably programmed during production of the hearing device. Thus, when the hearing device has been assembled, a model of the internal feedback path is estimated. To get a good estimate of the internal feedback path 204, it is necessary to do a system identification of the hearing device with a blocked external feedback path. One way to do this is to place the hearing device in a coupler (ear simulator) to provide suitable acoustic impedance to the receiver, i.e. an impedance substantially equal to the impedance of a wearer's ear. Any leaks, such as vents in In-The-Ear (ITE) hearing devices, must be sealed, so that all external feedback paths are eliminated. The hearing device (and coupler) may further be placed in an anechoic test box to eliminate sound reflections and noise from the surroundings. Then a system identification procedure, such as an open-loop gain measurement, is performed to measure F(w), cf. equations (1) and (2) above. One way to perform this is to have the device play back an MLS sequence (Maximum Length Sequence) on the output 202 and record it on the input 201. From the recorded feedback signal the internal feedback path can be estimated. The filter coefficients for the obtained model is then stored in the device and used during operation of the hearing device.

FIG. 3 is a plot of a prior art probe signal level as a function of time utilised for initialisation of two individual Digital Feedback Suppression Circuits in a hearing aid with a directional microphone system comprising a front microphone and a rear microphone. During fitting, the hearing aid is connected to a PC, and the illustrated probe signal is transmitted to the receiver of the hearing aid. Based on the microphone output signal that includes a response to the probe signal, the impulse responses of the feedback paths of the front microphone and the rear microphone are estimated. The illustrated probe signal ramps, e.g., linearly on a logarithmic scale, from zero level to the steady-state level in one second in order to allow the user to adapt to the probe signal. Subsequently, the probe signal remains at a constant level for 10 seconds. Typically, the constant level is of a magnitude that disturbs the user. The resulting front and rear microphone output signals are transmitted to the PC and the respective impulse responses are calculated. Then the PC determines the required parameters of the respective Digital Feedback Suppression Circuits, e.g. initial filter coefficients of adaptive digital filters, making them capable of modelling the respective feedback paths.

FIG. 4(*a*) shows a plot of a probe signal generated in accordance with an embodiment of the new method compared with the prior art probe signal shown in FIG. 3.

According to the known method shown in FIG. 3, and in order to allow the user to adapt to the probe signal, the probe signal is initially ramped (a) for one second linearly on a logarithmic scale from a low level, such as an inaudible level, e.g. a zero level, to a constant signal level (b). Thereafter, the signal level remains at the constant level (b) for 10 seconds during which, the initialization of the Digital Feedback Suppression Circuit is performed, and subsequently, the signal level of the probe signal is decreased again (c), e.g. to an inaudible level, e.g. is turned off.

According to the illustrated embodiment of the new method, the probe signal is also initially ramped (a) for one second linearly on a logarithmic scale from a low level, such as an inaudible level, e.g. a zero level, to a constant signal level (b). Thereafter, the signal level remains at the constant level (b) for 10 seconds during which, the initialization of the Digital Feedback Suppression Circuit is performed; however, instead of decreasing the probe signal level (c), e.g. to an inaudible level, e.g. turn the probe signal off, the probe signal is decreased linearly on a logarithmic scale (d) for a period of time that is equal to 5 seconds to a signal level that is equal to 70% of the signal level of the probe signal when the signal level was kept constant (b). Finally, the probe signal is turned-off (e).

The prolonging of the time period during which the user has to listen to the probe signal has the surprising effect that the user perceives the initialisation process to be less annoying. This is believed to be due to the above-mentioned "peak/end rule" and "duration neglect" according to which extending a period of pain can improve its remembered utility if the peak is unchanged and the new end is less aversive than the original end.

FIG. 4(*b*) shows a plot of a probe signal generated in accordance with an embodiment of the new method compared with the prior art probe signal disclosed in FIG. 4 of EP 2 205 005 A1.

According to the known method disclosed in EP 2 205 005 A1, the probe signal is initially ramped (a) linearly on a logarithmic scale from a low level, such as an inaudible level, e.g. a zero level, while the value of a first quality parameter is monitored. When the first quality parameter value has reached a predetermined first threshold value, the probe signal is kept constant at the corresponding signal level (b) while the value of a second quality parameter is monitored. When the second quality parameter value has reached a predetermined second threshold value, the initialization of the Digital Feedback Suppression Circuit has been performed to the desired accuracy, and the probe signal level is decreased again (c), e.g. to an inaudible level, e.g. is turned off.

According to the illustrated embodiment of the new method, the probe signal is also initially ramped (a) linearly on a logarithmic scale from a low level, such as an inaudible level, e.g. a zero level, while the value of a first quality parameter is monitored, and when the first quality parameter value has reached a predetermined first threshold value, the probe signal is kept constant at the corresponding signal level (b) while the value of a second quality parameter is monitored, and when the second quality parameter value has reached a predetermined second threshold value, the initialization of the Digital Feedback Suppression Circuit has been performed to the desired accuracy; however instead of decreasing the probe signal level (c), e.g. to an inaudible level, e.g. turn the probe signal off, the probe signal is decreased linearly on a logarithmic scale (d) for a period of time that is equal to 50% of the time during which the signal level of the probe signal was kept constant (b) to a signal level that is equal to 70% of the signal level of the probe signal when the signal level was kept constant (b). Finally, the probe signal is turned-off (e).

The prolonging of the time period during which the user has to listen to the probe signal has the surprising effect that the user perceives the initialisation process to be less annoying. This is believed to be due to the above-mentioned "peak/end rule" and "duration neglect" according to which extending a period of pain can improve its remembered utility if the peak is unchanged and the new end is less aversive than the original end.

FIG. 5 schematically illustrates a hearing aid with a Digital Feedback Suppression Circuit initialised in accordance with the new method. The probe signal is a Maximum Length Sequence (MLS) signal generated in the MLS Signal Generator and output to an amplifier (Ramp Scale) with a controlled gain that is controlled as function of time as illustrated in FIGS. 4(*a*) and 4(*b*). The feedback signal is received by the microphone and digitised and a block of signal samples is accumulated in the frame accumulator. In the illustrated example, the data block is transferred to a PC for processing to extract the impulse response. The PC performs cross-correlation of the probe signal with the received signal to determine the impulse response. Alternatively, the impulse response may be calculated by the signal processor of the hearing aid itself. The quality of the impulse response is then assessed, in the illustrated example by the PC, but alternatively by the signal processor of the hearing aid. A first quality parameter value is calculated and compared with a first threshold value. If the first quality parameter value has not reached the first threshold value, the probe signal level is increased, otherwise the signal level remains at a constant level and the steady-state measurement stage is entered. A second quality parameter value is calculated and compared to a second threshold value. If the second quality parameter value has not reached the second threshold value, a new block of data is collected and a new second quality parameter value is calculated, otherwise, the initialization sequence is terminated, and in the illustrated hearing aid, the PC calculates the corresponding parameter values of the Digital Feedback Suppression Circuit and transfers the values to the hearing aid.

A maximum allowable signal level and duration of the probe signal are imposed which are equivalent to what the standard initialization signal level and duration would have been according to the conventional initialisation process.

The quality parameters based on the impulse response of the feedback path may be Peak to Peak Ratio (PPR) of the head and tail parts of an impulse response Noise to Noise Ratio (NNR) of the head and tail parts of an impulse response Peak to Signal Noise Ratio (PSNR) of the impulse response The impulse response may be extracted by the Digital Signal Processor of the hearing aid. The impulse response may be obtained by cross-correlating the MLS sequence with the received response. Although the DSP operates in a block-based manner, extracting the impulse response is a computationally-intensive process and the cross-correlation cannot be completed within one block. The impulse response extraction has to be spread over many blocks.

The PPR is defined as the ratio of the peak magnitude in the head part to the peak in the tail part of the impulse response, expressed in dB. In this application the head and tail parts are defined as the first-half and last-half of the impulse response respectively.

The NNR is defined as the ratio of the noise level in the head part to the noise level in the tail part of the impulse response, expressed in dB. In this application the head and tail parts are defined as the first-half and last-half of the impulse response respectively. The noise level is computed using the RMS value. In an application without a DC removal filter, the variance could be used to obtain similar results.

PSNR is defined as the ratio of the signal peak to Root-Mean-Square (RMS) noise, expressed in dB. In this application it is estimated as the ratio of the peak magnitude of the extracted impulse response to the RMS value of the last 64 samples of the response.

In the illustrated example, the new initialization process is terminated when both PPR and NNR exceed specific threshold values. The PSNR may also constitute a robust and reliable measure of quality.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A method for modelling a feedback path from a receiver to a microphone in a hearing device, comprising:

transmitting an electronic probe signal to the receiver;

obtaining a microphone output signal that is associated with an output of the receiver; and determining at least one parameter of the feedback path based on the microphone output signal;

wherein the electronic probe signal comprises a first signal level, followed by a second signal level that is less than the first signal level, the second signal level being greater than zero.

2. The method according to claim 1, wherein the first signal level comprises a peak signal level, an average signal level, or an rms signal level.

3. The method according to claim 1, further comprising:

increasing a level of the electronic probe signal while monitoring values of a first quality parameter calculated based on the microphone output signal; and refraining from further increasing the level of the electronic probe signal when the determined first quality parameter has reached a predetermined first threshold value.

4. The method according to claim 3, further comprising:

monitoring values of a second quality parameter calculated based on the microphone output signal; and terminating the transmission of the electronic probe signal to the receiver when the determined second quality parameter has reached a predetermined second threshold value.

5. The method according to claim 4, wherein the first quality parameter and the second quality parameter are identical.

6. The method according to claim 4, wherein at least one of the first quality parameter and the second quality parameter is a function of the microphone output signal.

7. The method according to claim 1, further comprising estimating an impulse response of the feedback path.

8. The method according to claim 1, wherein the first signal level comprises a maximum allowable level.

9. The method according to claim 1, wherein the electronic probe signal has a third signal level that is smaller than the second signal level.

10. The method according to claim 9, wherein the third signal level comprises a zero level.

11. A method for modelling a feedback path from a receiver to a microphone in a hearing device, comprising:

transmitting an electronic probe signal to the receiver;

obtaining a microphone output signal that is associated with an output of the receiver; and determining at least one parameter of the feedback path based on the microphone output signal;

wherein the electronic probe signal comprises a first signal level, followed by a second signal level that is less than the first signal level, the second signal level being greater than zero; and wherein the electronic probe signal has a first signal portion with a first duration, and a second signal portion with a second duration, wherein the first signal portion comprises the first signal level, and wherein the second signal portion comprises the second signal level.

12. The method according to claim 11, wherein the second signal portion decreases linearly.

13. The method according to claim 11, wherein the second signal portion decreases non-linearly.

14. The method according to claim 11, wherein the second signal portion decreases in a step-wise fashion.

15. The method according to claim 11, wherein the second duration is more than 10%, 20% 30% 40% 50%, or 60%, of a time period required for initialization of a digital feedback suppression circuit in a hearing device that comprises the receiver.

16. The method according to claim 11, wherein the second signal portion comprises an end portion of the electronic probe signal.

17. The method according to claim 11, wherein the act of determining the at least one parameter of the feedback path is completed before the second signal portion of the electronic probe signal is transmitted.

18. The method according to claim 11, wherein at least a part of the act of determining the at least one parameter of the feedback path is performed after at least a part of the second signal portion has been transmitted.

19. The method according to claim 11, wherein the first signal level comprises a peak signal level, an average signal level, or an rms signal level.

20. The method according to claim 11, further comprising:

increasing a level of the electronic probe signal while monitoring values of a first quality parameter calculated based on the microphone output signal; and refraining from further increasing the level of the electronic probe signal when the determined first quality parameter has reached a predetermined first threshold value.

21. The method according to claim 20, further comprising:

monitoring values of a second quality parameter calculated based on the microphone output signal; and terminating the transmission of the electronic probe signal to the receiver when the determined second quality parameter has reached a predetermined second threshold value.

22. The method according to claim 21, wherein the first quality parameter and the second quality parameter are identical.

23. The method according to claim 21, wherein at least one of the first quality parameter and the second quality parameter is a function of the microphone output signal.

24. The method according to claim 11, further comprising estimating an impulse response of the feedback path.

25. The method according to claim 11, wherein the first signal level comprises a maximum allowable level.

26. The method according to claim 11, wherein the electronic probe signal has a third signal level that is smaller than the second signal level.

27. The method according to claim 26, wherein the third signal level comprises a zero level.

28. A method for modelling a feedback path from a receiver to a microphone in a hearing device, comprising:

transmitting an electronic probe signal to the receiver;

obtaining a microphone output signal that is associated with an output of the receiver; and determining at least one parameter of the feedback path based on the microphone output signal;

wherein the electronic probe signal comprises a first signal level, followed by a second signal level that is less than the first signal level, the second signal level being greater than zero; and wherein the second signal level is less than the first signal level by an amount that is more than 1%, 2%, 5%, 10%, 20%, or 50% of the first signal level.

29. The method according to claim 28, wherein the first signal level comprises a peak signal level, an average signal level, or an rms signal level.

30. The method according to claim 28, further comprising:

increasing a level of the electronic probe signal while monitoring values of a first quality parameter calculated based on the microphone output signal; and refraining from further increasing the level of the electronic probe signal when the determined first quality parameter has reached a predetermined first threshold value.

31. The method according to claim 30, further comprising:

monitoring values of a second quality parameter calculated based on the microphone output signal; and terminating the transmission of the electronic probe signal to the receiver when the determined second quality parameter has reached a predetermined second threshold value.

32. The method according to claim 31, wherein the first quality parameter and the second quality parameter are identical.

33. The method according to claim 31, wherein at least one of the first quality parameter and the second quality parameter is a function of the microphone output signal.

34. The method according to claim 28, further comprising estimating an impulse response of the feedback path.

35. The method according to claim 28, wherein the first signal level comprises a maximum allowable level.

36. The method according to claim 28, wherein the electronic probe signal has a third signal level that is smaller than the second signal level.

37. The method according to claim 36, wherein the third signal level comprises a zero level.

38. A method for modelling a feedback path from a receiver to a microphone in a hearing device, comprising:

transmitting an electronic probe signal to the receiver;

obtaining a microphone output signal that is associated with an output of the receiver; and determining at least one parameter of the feedback path based on the microphone output signal;

wherein the electronic probe signal comprises a first signal level, followed by a second signal level that is less than the first signal level, the second signal level being greater than zero; and wherein the second signal level is more than 1 dB, 2 dB, 3 dB, 4 dB, 5 dB, or 6 dB, below the first signal level.

39. The method according to claim 38, wherein the first signal level comprises a peak signal level, an average signal level, or an rms signal level.

40. The method according to claim 38, further comprising:

increasing a level of the electronic probe signal while monitoring values of a first quality parameter calculated based on the microphone output signal; and refraining from further increasing the level of the electronic probe signal when the determined first quality parameter has reached a predetermined first threshold value.

41. The method according to claim 40, further comprising:

monitoring values of a second quality parameter calculated based on the microphone output signal; and terminating the transmission of the electronic probe signal to the receiver when the determined second quality parameter has reached a predetermined second threshold value.

42. The method according to claim 41, wherein the first quality parameter and the second quality parameter are identical.

43. The method according to claim 41, wherein at least one of the first quality parameter and the second quality parameter is a function of the microphone output signal.

44. The method according to claim 38, further comprising estimating an impulse response of the feedback path.

45. The method according to claim 38, wherein the first signal level comprises a maximum allowable level.

46. The method according to claim 38, wherein the electronic probe signal has a third signal level that is smaller than the second signal level.

47. The method according to claim 46, wherein the third signal level comprises a zero level.

48. A hearing device comprising:

a microphone;

a receiver configured to receive an electronic probe signal from a probe signal generator, wherein the electronic probe signal comprises a first signal level, followed by a second signal level that is less than the first signal level, the second signal level being greater than zero;

a digital feedback suppression circuit for modelling a feedback path between the receiver and the microphone; and a signal processor configured to determine at least one parameter of the feedback path based on a microphone output signal.

49. The hearing device according to claim 48, wherein the hearing device is a hearing aid comprising a hearing loss processor for processing the audio signal into a hearing loss compensated audio signal for compensation of a hearing loss of a user of the hearing aid.

50. The hearing device according to claim 48, wherein the digital feedback suppression circuit is a part of the signal processor.

51. The hearing device of claim 48, wherein the electronic probe signal has a first signal portion with a first duration, and a second signal portion with a second duration, wherein the first signal portion comprises the first signal level, and wherein the second signal portion comprises the second signal level.

52. The hearing device of claim 48, wherein the second signal level is less than the first signal level by an amount that is more than 1%, 2%, 5%, 10%, 20%, or 50% of the first signal level.

53. The hearing device of claim 48, wherein the second signal level is more than 1 dB, 2 dB, 3 dB, 4 dB, 5 dB, or 6 dB, below the first signal level.

* * * * *